US008433228B2

(12) United States Patent
Keenan et al.

(10) Patent No.: US 8,433,228 B2
(45) Date of Patent: Apr. 30, 2013

(54) METHOD AND APPARATUS FOR STRIPPING MEDIA FROM A SURFACE IN AN APPARATUS USEFUL FOR PRINTING

(75) Inventors: Christine A. Keenan, Fairport, NY (US); Augusto E. Barton, Webster, NY (US); Anthony S. Condello, Webster, NY (US)

(73) Assignee: Xerox Corporation

( * ) Notice: Subject to any disclaimer, the term of this patent is extended or adjusted under 35 U.S.C. 154(b) by 410 days.

(21) Appl. No.: 12/352,250

(22) Filed: Jan. 12, 2009

(65) Prior Publication Data

US 2010/0178085 A1 Jul. 15, 2010

(51) Int. Cl.
*G03G 15/20* (2006.01)

(52) U.S. Cl.
USPC ..... 399/323; 399/45

(58) Field of Classification Search ..... 399/322, 399/323, 398, 399
See application file for complete search history.

(56) References Cited

U.S. PATENT DOCUMENTS

| | | | | |
|---|---|---|---|---|
| 4,408,757 | A | 10/1983 | Yarm | |
| 5,548,389 | A * | 8/1996 | Bowler, Jr. | |
| 5,617,197 | A * | 4/1997 | Kawabata et al. | 399/398 |
| 5,758,252 | A * | 5/1998 | Enomoto et al. | |
| 2006/0088346 | A1 | 4/2006 | Swanson | |
| 2006/0210331 | A1 | 9/2006 | Baba et al. | |
| 2006/0285134 | A1 | 12/2006 | Viturro et al. | |
| 2007/0048035 | A1 | 3/2007 | Baba et al. | |
| 2007/0048042 | A1 | 3/2007 | Uehara et al. | |
| 2007/0092277 | A1 * | 4/2007 | Miyata et al. | |
| 2007/0166084 | A1 | 7/2007 | Yoshino et al. | |
| 2007/0172272 | A1 | 7/2007 | Miyata et al. | |
| 2008/0037069 | A1 | 2/2008 | Mestha et al. | |

FOREIGN PATENT DOCUMENTS

| | | | |
|---|---|---|---|
| JP | 61045263 A | * | 3/1986 |
| JP | 01118175 A | * | 5/1989 |
| JP | 05313535 A | * | 11/1993 |
| JP | 2005215601 A | * | 8/2005 |

OTHER PUBLICATIONS

European Search Report dated Apr. 21, 2010, in Connection with Related EP Application No. 10150336.5.

* cited by examiner

*Primary Examiner* — Walter L Lindsay, Jr.
*Assistant Examiner* — Milton Gonzalez
(74) *Attorney, Agent, or Firm* — Ellis B. Ramirez; Richard A. Castellano; Ronald E. Prass, Jr.

(57) ABSTRACT

Apparatuses useful for printing and methods of stripping media from surfaces in apparatuses useful for printing are provided. An exemplary embodiment of an apparatus useful for printing comprises a first roll; a belt including an inner surface and an outer surface, the first roll and the outer surface of the belt forming a nip; and a stripping member located internal to the belt. The stripping member includes at least a first stripping surface and a second stripping surface having a smaller curvature than the first stripping surface. The stripping member is rotatable to selectively position one of the first stripping surface and the second stripping surface in contact with the inner surface of the belt. The one of the first stripping surface and the second stripping surface facilitates stripping of a medium fed to the nip from the outer surface of the belt.

18 Claims, 6 Drawing Sheets

METHOD AND APPARATUS FOR STRIPPING MEDIA FROM A SURFACE IN AN APPARATUS USEFUL FOR PRINTING

BACKGROUND

In some printing apparatuses, images are formed on media using a marking material. Such printing apparatuses can include a roll and a belt that define a nip. Media are fed to the nip and heated to treat the marking material.

It would be desirable to provide apparatuses useful for printing and methods that can strip media from surfaces efficiently.

SUMMARY

Apparatuses useful for printing and methods of stripping media from surfaces in apparatuses useful for printing are provided. An exemplary embodiment of an apparatus useful for printing comprises a first roll; a belt including an inner surface and an outer surface, the first roll and the outer surface of the belt forming a nip; and a stripping member located internal to the belt. The stripping member includes at least a first stripping surface and a second stripping surface having a smaller curvature than the first stripping surface. The stripping member is rotatable to selectively position one of the first stripping surface and the second stripping surface in contact with the inner surface of the belt. The one of the first stripping surface and the second stripping surface in contact with the inner surface of the belt facilitates stripping of media fed to the nip from the outer surface of the belt.

DRAWINGS

DETAILED DESCRIPTION

Figure 1:
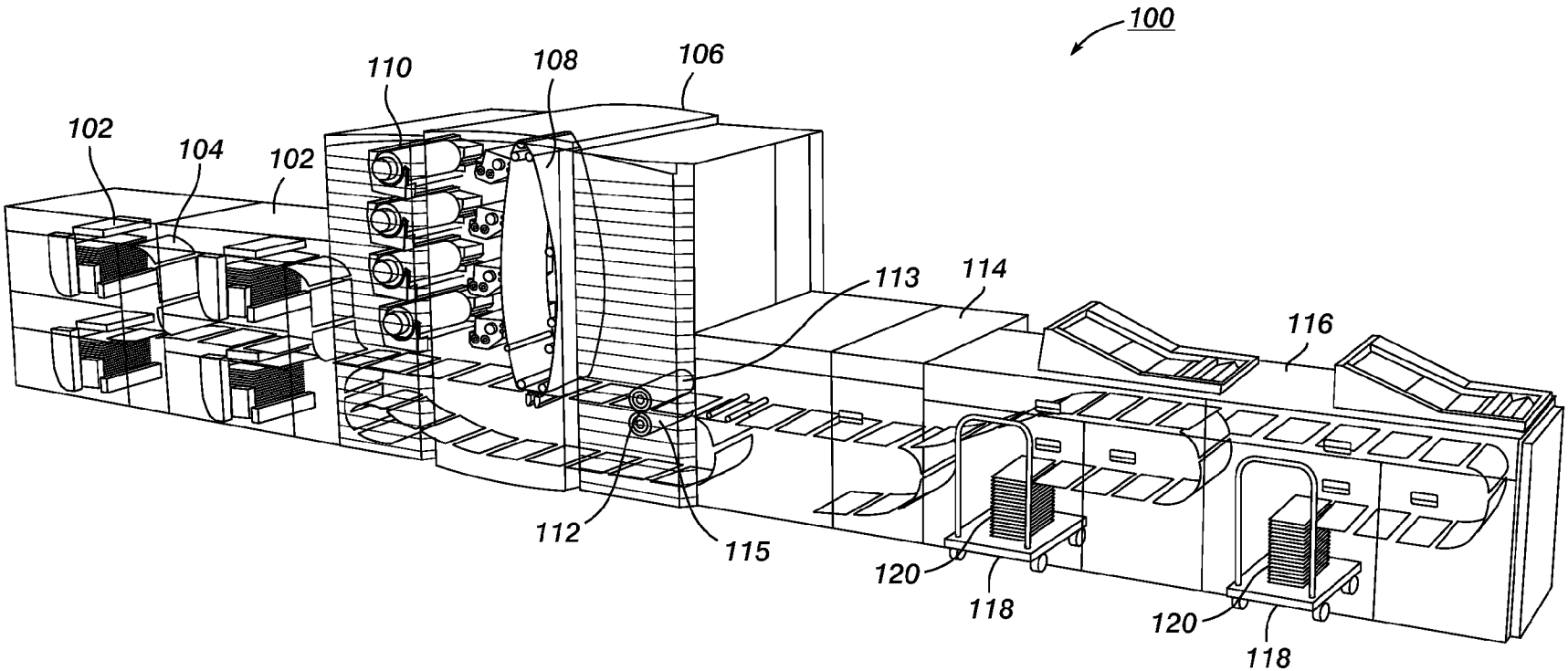
FIG. 1 depicts an exemplary embodiment of a printing apparatus.

The disclosed embodiments include an apparatus useful for printing comprising a first roll; a belt including an inner surface and an outer surface, the first roll and the outer surface of the belt forming a nip; and a stripping member located internal to the belt. The stripping member includes at least a first stripping surface and a second stripping surface having a smaller curvature than the first stripping surface. The stripping member is rotatable to selectively position one of the first stripping surface and the second stripping surface in contact with the inner surface of the belt. The one of the first stripping surface and the second stripping surface facilitates stripping of media fed to the nip from the outer surface of the belt.

The disclosed embodiments further an apparatus useful for printing comprising a first roll; a second roll; a belt disposed between the first roll and second roll, the belt including an inner surface and an outer surface; a primary nip formed by the belt contacting the first roll and the second roll, the primary nip including an inlet end where a medium enters the primary nip and an outlet end where the medium exits the primary nip; a stripping member located between the second roll and the inner surface of the belt, the stripping member including at least a first stripping surface and a second stripping surface having a smaller curvature than the first stripping surface, wherein the stripping member is rotatable to selectively position one of the first stripping surface and the second stripping surface in contact with the inner surface of the belt to strip the medium from the belt after the medium exits from the outlet end of the primary nip; and a cleaning member for cleaning the first stripping surface and the second stripping surface.

The disclosed embodiments further include a method of stripping media from a surface in an apparatus useful for printing. The apparatus comprises a first roll, a belt including an inner surface and an outer surface, and a nip formed by the first roll and the belt. The method comprises contacting a first medium carrying a first marking material with the outer surface of the belt at the nip; rotating a stripping member including at least a first surface and a second stripping surface having a different curvature than the first stripping surface to position the first surface in contact with the inner surface of the belt; and stripping the first medium from the belt using the stripping member with the first stripping surface in contact with the inner surface.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

FIG. 1 illustrates an exemplary printing apparatus 100 as disclosed in U.S. Patent Application Publication No. 2008/0037069, which is incorporated herein by reference in its entirety. The printing apparatus 100 can be used to produce prints with different media types.

The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114. In the printing apparatus 100, the media feeder modules 102 feed media to the printer module 106. In the printer module 106, toner is transferred from a series of developer stations 110 to a charged photoreceptor belt 108 to form toner images on the photoreceptor belt 108 and produce color prints. The toner images are transferred to respective media 104 fed through the paper path. The media are advanced through a fuser 112 including a fuser roll 113 and pressure roll 115, which form a nip where heat and pressure are applied to the media to fuse toner images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful for printing and methods of stripping media in apparatuses useful for printing are provided. Embodiments of the apparatuses are constructed to treat marking material on different media types. Embodiments of the apparatuses include a belt. The belt can be heated to supply thermal energy to media. The apparatuses are adapted to strip different types of media from the belt.

Figure 2:
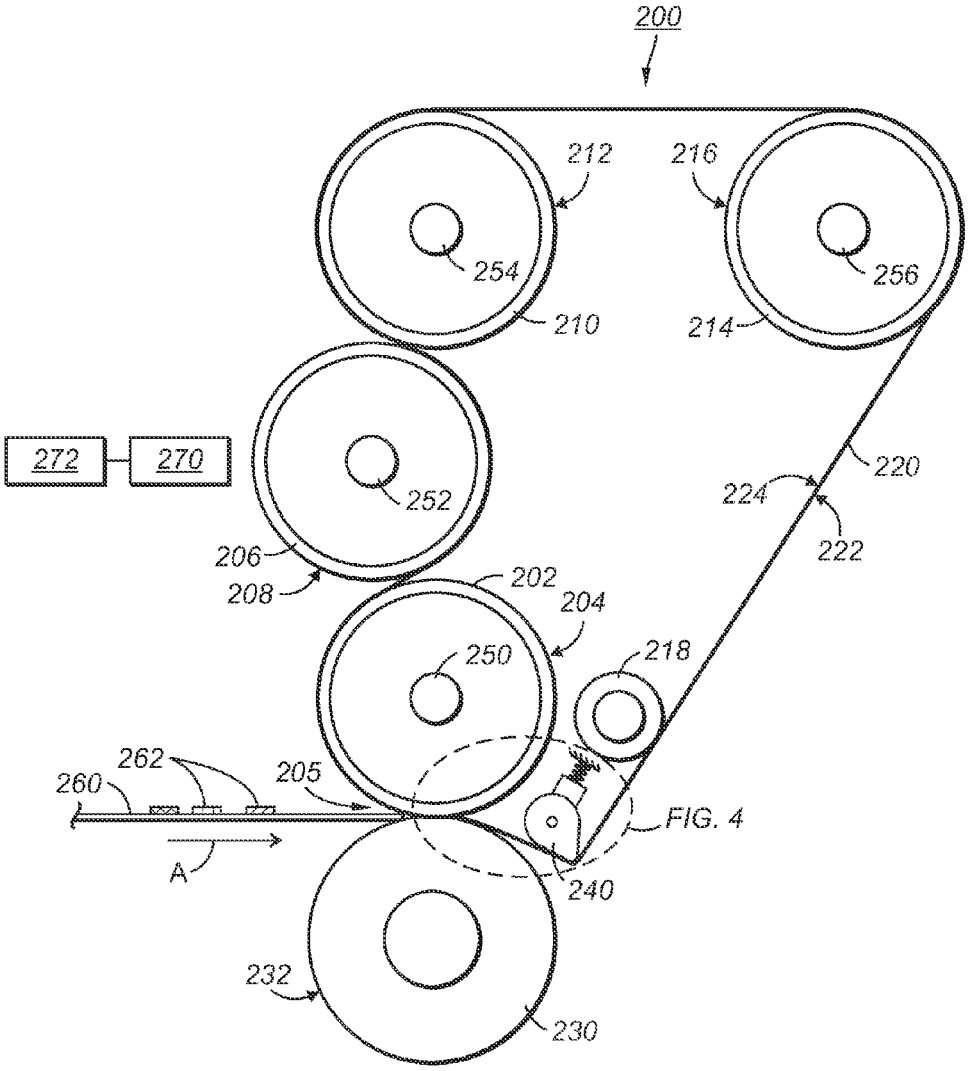
FIG. 2 depicts an exemplary embodiment of a fuser used to treat a thin medium.

FIG. 2 illustrates an exemplary embodiment of an apparatus useful for printing. The apparatus is a fuser 200. The fuser 200 is constructed to facilitate stripping of different media types that may be used in the fuser 200. Embodiments of the fuser 200 can be used with different types of printing apparatuses. For example, the fuser 200 can be used in place of the fuser 112 in the printing apparatus 100 shown in FIG. 1.

As shown in FIG. 2, the fuser 200 includes a continuous belt 220 provided on a fuser roll 202, external roll 206, internal rolls 210, 214 and an idler roll 218. The belt 220 has an outer surface 222 and an inner surface 224. In other embodiments, the fuser 200 can include less than, or more than, four rolls supporting the belt 220.

The fuser roll 202, external roll 206 and internal rolls 210, 214 have outer surfaces 204, 208, 212 and 216, respectively, contacting the belt 220. The fuser roll 202, external roll 206 and internal rolls 210, 214 include internal heating elements 250, 252, 254 and 256, respectively. The heating elements 250, 252, 254 and 256 can be, e.g., axially-extending lamps. The heating elements are connected to a power supply 270 in a conventional manner. In embodiments, each of the fuser roll 202, external roll 206, and internal rolls 210, 214 can include more than one heating element. For example, each of these rolls can include one long lamp and one short lamp. The power supply 270 is connected to a controller 272 in a conventional manner. The controller 272 controls the operation of the power supply 270 to control the supply of voltage to the heating elements 250, 252, 254 and 256, so as to heat the belt 220 to the desired temperature.

The fuser 200 further includes an external pressure roll 230 having an outer surface 232, which is shown engaging the belt 220. The pressure roll 230 and belt 220 forms a nip 205 between the outer surface 232 and the outer surface 222. In embodiments, the pressure roll 230 includes a core and an outer layer with the outer surface 232 overlying the core. The core can be comprised of aluminum or the like, and the outer layer can be comprised of an elastically deformable polymeric material.

Embodiments of the belt 220 can include, e.g., a base layer, an intermediate layer on the base layer, and an outer layer on the intermediate layer. In such embodiments, the base layer forms the inner surface 224 and the outer layer forms the outer surface 222 of the belt 220. In an exemplary embodiment of the belt 220, the base layer is comprised of a polymeric material, such as polyimide, or the like; the intermediate layer is comprised of silicone, or the like; and the outer layer is comprised of a polymeric material, such as a fluoroelastomer sold under the trademark Viton® by DuPont Performance Elastomers, L.L.C., polytetrafluoroethylene (Teflon®), or the like.

In embodiments, the belt 220 can have a thickness of about 0.1 mm to about 0.6 mm. For example, the belt 220 can include a base layer having a thickness of about 50 μm to about 100 μm, an intermediate layer having a thickness of about 100 μm to about 500 μm, and an outer layer having a thickness of about 20 μm to about 40 μm. The belt 220 can typically have a width of about 350 mm to about 450 mm, and a length of about 500 mm to at least about 1000 mm.

FIG. 2 depicts a medium 260 being fed to the nip 205 in the process direction A. The fuser roll 202 is rotated counter-clockwise and the pressure roll 230 is rotated clockwise to convey the medium 260 through the nip 205 in the process direction A and rotate the belt 220 counter-clockwise. The medium 260 can be, e.g., a paper sheet. Typically, paper is classified by weight. Light-weight paper has a weight of ≦ about 75 gsm, medium-weight paper has a weight of about 75 gsm to about 160 gsm, and heavy-weight paper has a weight of ≧160 gsm. Typically, a low toner mass is less than about 0.8 mg/cm$^2$, while a high toner mass is at least about 0.8 mg/cm$^2$. Media can be coated or uncoated. A larger amount of energy (both per thickness and per basis weight) is used to treat marking material on coated media as compared to uncoated media. For example, a higher fusing temperature is used to fuse toner on heavy-weight media as compared to light-weight media.

The outer surface 232 of the pressure roll 230 is deformed by contact with the belt 220 on the fuser roll 202. The outer surface 204 of the fuser roll 202 may also be deformed by this contact depending on the hardness of the material forming the outer surface 204. For example, when the outer surface 204 is made of an elastically deformable material, the outer surface 204 can also be deformed by contact with the pressure roll 230.

The "nip width" is the distance between the nip entrance and the nip exit in the process direction. The nip width can be expressed as the product of the dwell and process speed (i.e., nip width=dwell×process speed). FIG. 2 depicts a case where the medium 260 fed to the nip 205 is a light-weight medium, such as light-weight paper. A marking material 262, e.g., toner, is on a top surface of the medium 260 facing the belt 220. The medium 260 can be coated or uncoated. In this case, the belt 220 and pressure roll 230 forms a small nip width.

Figure 3:
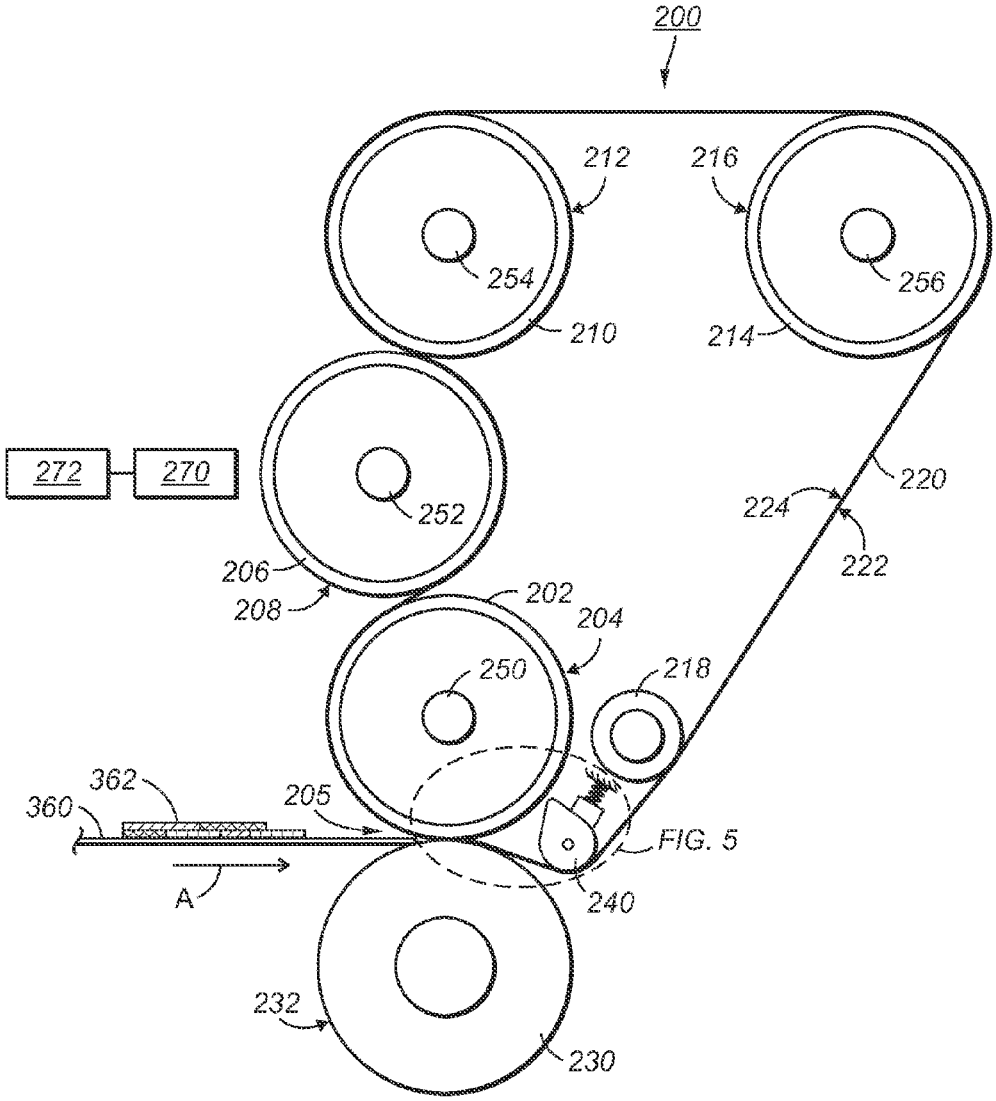
FIG. 3 depicts the fuser shown in FIG. 2 used to treat a thick medium.

FIG. 3 depicts a case where a heavy-weight medium 360, such as heavy-weight paper, is being fed to the nip 205 in the fuser 200. A marking material 362, e.g., toner, is on a top surface of the medium 360 facing the belt 220. The medium 360 can be coated or uncoated. In this case, there is a larger nip width and higher pressure between the belt 220 and pressure roll 230 than for the case of a light-weight medium depicted in FIG. 2.

As shown in FIGS. 2 and 3, the fuser 200 further includes a stripping member 240. The stripping member 240 is located internally to the belt 220, i.e., on the side of the inner surface 224. The stripping member 240 is configured to facilitate stripping of different types of media from the belt 220. The media that may be used in the fuser 200 range from light-weight to heavy-weight types, and the media can be coated or uncoated.

Embodiments of the stripping member 240 include at least two stripping surfaces having different respective curvatures. The stripping member 240 is rotatable relative to the belt 220 to selectively position one of the stripping surfaces in contact with the inner surface 224. The stripping surface of the stripping member 240 that is used can be selected based on one or more characteristics of the media that are run in the apparatus. Such characteristics affect the stiffness of the media and can include media thickness and marking material mass.

Figure 4:
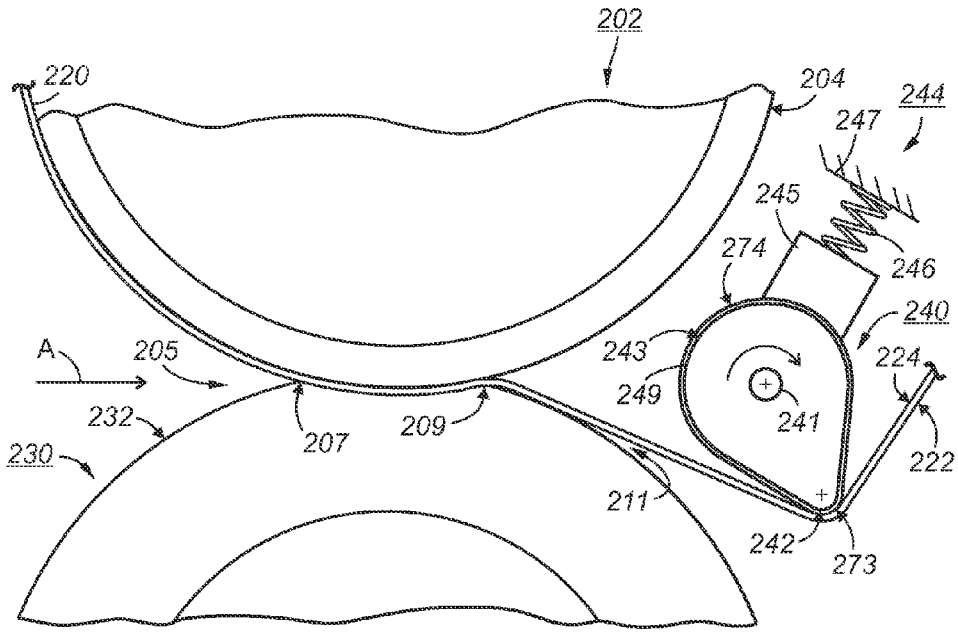
FIG. 4 is an enlarged view of a portion of the fuser shown in FIG. 2.

FIG. 4 depicts a portion of the fuser 200 including the fuser roll 202, pressure roll 230, belt 220 and stripping member 240. The belt 220 is located between the outer surface 204 of the fuser roll 202 and the outer surface 232 of the pressure roll 230. FIG. 4 corresponds to the case depicted in FIG. 2 where a light-weight medium is used.

As shown in FIG. 4, the nip 205 extends in the process direction A between an inlet end 207 and an outlet end 209. The distance between the inlet end 207 and the outlet end 209 is the nip width of the nip 205. The nip 205 between the inlet end 207 and outlet end 209 is also referred to herein as the "primary nip." Media are fed to the inlet end 207 and exit from the outlet end 209. The primary nip is a high-pressure zone where heat and pressure are applied to treat marking material on media. For example, toner can be fused on media by heating the media to at least a fusing temperature of the toner. The belt 220 contacts the fuser roll 202 and the pressure roll 230 at the nip 205. The belt 220 separates from the outer surface 204 of the fuser roll 202 at the outlet end 209. The stripping member 240 is located sufficiently close to the outlet end 209 to allow media to be stripped immediately after exiting the nip 205.

The stripping member 240 has a profiled outer surface 248 including a curved first surface 242 and a curved second surface 243. The illustrated stripping member 240 has a teardrop shape. In embodiments, the body of the stripping member 240 defined by the outer surface 248 can be comprised of metal, such as steel, aluminum, or the like. The material used to form the body of the stripping member 240 desirably has sufficiently-high rigidity to undergo an acceptable amount of deflection when subjected to a load from the tension of the belt 220. In embodiments, the stripping member 240 has a sufficient length along the axial direction of the fuser roll 202 to contact the entire width of the belt 220. In an exemplary embodiment, the body of the stripping member 240 is comprised of steel, has an axial length of about 460 mm, and deflects about 0.4 mm when subjected to a load of about 36 kg from tension of the belt.

As depicted, an optional coating 249 comprised of a low-friction material is provided on the entire outer surface 248 of the body to reduce wear of the inner surface 224 of the belt 220 caused by contact with the stripping member 240 during rotation of the belt 220. In other embodiments, the coating 249 can cover only the first surface 242 and second surface 243. The low-friction material can be, e.g., TEFLON®, or the like. The coating 249 can have a thickness of about 20 μm to about 500 μm, for example. The coating 249 can have a uniform thickness over the outer surface 248. The coating 249 includes an outer surface having a first surface 273 overlying the first surface 242 and a second surface 274 overlying the second surface 243. In embodiments, the first surface 273 and second surface 274 follow the contours of the first surface 242 and second surface 243, respectively. In the illustrated embodiment, the first surface 273 and second surface 274 form stripping surfaces, which can be selectively positioned to contact the inner surface 224 of the belt 220.

In embodiments of the stripping member 240 that do not include the coating 249, and the outer surface 248 forms the outer surface of the stripping member 240, the first surface 242 and second surface 243 form stripping surfaces. In such embodiments, the first surface 242 and second surface 243 can be selectively positioned in contact with the inner surface 224 of the belt 220.

In embodiments, the stripping member 240 is rotatable to selectively position the first surface 273 or the second surface 274 (or the first surface 242 or second surface 243 in embodiments that do not include the optional coating 249) in contact with the inner surface 224 of the belt 220. The stripping member 240 can be rotated by any suitable mechanism (not shown), such as a motor, or the like, operatively coupled to the shaft 241 of the stripping member 240 in a conventional manner. In embodiments, the controller 272 can be connected to the mechanism to control positioning of the stripping member 240 with respect to the belt 220.

The first surface 273 and second surface 274 of the stripping member 240 (or, in other embodiments, the first surface 242 and second surface 243) are configured to mechanically separate (strip) media carrying marking material from the outer surface 222 of the belt 220. Media are stripped from the outer surface 222 at a location adjacent the one of the first surface 273 or second surface 274 that is positioned in contact with the belt 220.

The portion of the belt 220 extending between the outlet end 209 and the first surface 273 or the second surface 274 (or, in other embodiments, the first surface 242 or the second surface 243) of the stripping member 240 that contacts the belt 220 forms a secondary nip 211 between the outer surface 222 of the belt 220 and the outer surface 232 of the pressure roll 230. In the secondary nip 211, the belt 220 is spaced from the outer surface 204 of the fuser roll 202.

In embodiments, the first surface 242 and second surface 243 of the stripping member 240 have different curvatures from each other. The first surface 273 and second surface 274 have different curvatures from each other, and these curvatures can correspond to the curvatures of the first surface 242 and second surface 243, respectively. For example, the first surface 242 and second surface 243 can each be circular-shaped, as shown in FIG. 4, or either of these surfaces can have any other curved shapes that provide the desired stripping assistance. Such shapes can include, e.g., parabolic, elliptical and like shapes.

Figure 5:
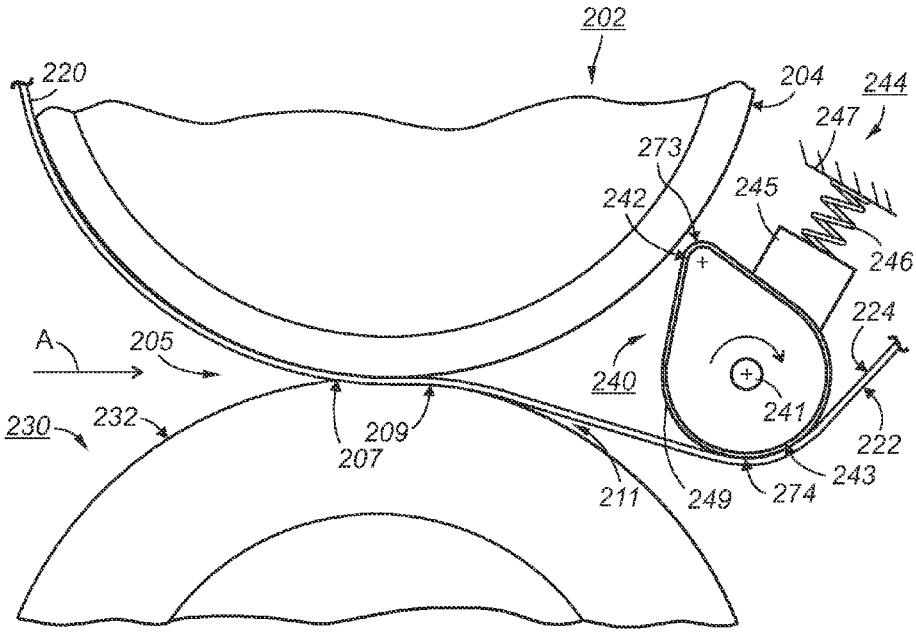
FIG. 5 is an enlarged view of a portion of the fuser shown in FIG. 3.
Figure 6:
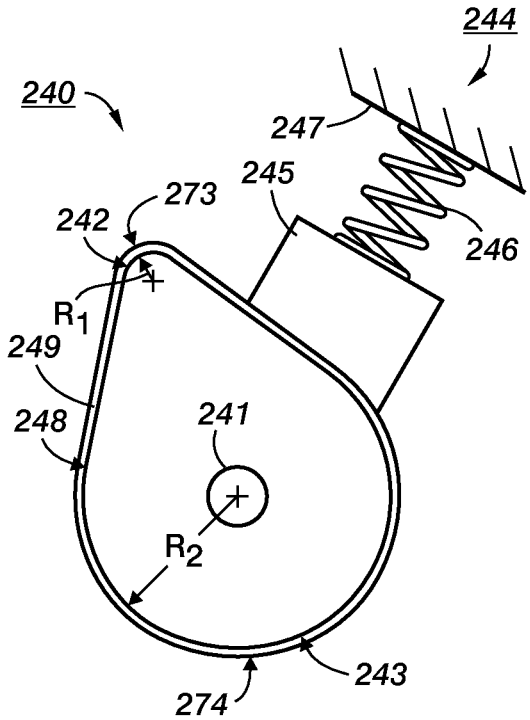
FIG. 6 is an enlarged view of the stripping member depicted in FIGS. 4 and 5.

As shown in FIGS. 4 to 6, the first surface 242 has a larger curvature than the second surface 243. The first surface 242 is described by a radius, $R_1$, and the second surface 243 is described by a larger radius, $R_2$. For example, $R_1$ can have a length of about 0.5 mm to about 2 mm, and $R_2$ can have a length of about 4 mm to about 5 mm. The coating 249 effectively increases the length of $R_1$ and $R_2$ by an amount dependent on the thickness of the coating 249 over the first surface 242 and second surface 243. Decreasing the radius $R_1$ describing the first surface 242, or decreasing the radius $R_2$ describing the second surface 243, increases the stripping force of that surface (or, in other embodiments, of the first surface 273 or second surface 274). Thin media carrying a high toner mass are typically the most difficult media to strip from the belt. Consequently, the highest stripping force is used to strip such light-weight media. The first surface 273 (or the first surface 242) has a larger curvature that provides a sufficiently-high stripping force to strip such light-weight media from the belt 220.

In embodiments, the lengths of the stripping surfaces of the stripping member 240 over which the belt 220 advances during its rotation (e.g., first surface 242 or second surface 243) can be increased or decreased to facilitate release of different media types from the outer surface 222 of the belt 220.

FIG. 5 corresponds to the case depicted in FIG. 3 where a heavy-weight medium is used in the fuser 200. In FIG. 5, the second surface 274 with a smaller curvature is positioned in contact with the inner surface 224 of the belt 220. The stripping member 240 can be positioned such that a portion of the coating 249 located between the first surface 273 and the second surface 274 contacts the inner surface 224 of the belt 220, as shown in FIG. 3. Heavy-weight media with a low toner mass are typically easiest to strip. Consequently, the lowest stripping force can be used to strip such heavy-weight media. The second surface 274 (or the second surface 243) provides a sufficiently-high stripping force to strip medium-weight or heavy-weight media from the belt 220.

Contact between either of the stripping surfaces of the stripping member 240 and the belt 220 can cause wear of the inner surface 224. This wear can result in solid debris, such as polymer particles, as well as liquids, such as oil, accumulating between the stripping member 240 and the inner surface 224 on the first surface 273 or second surface 274 (or, in other embodiments, on the first surface 242 or second surface 243) of the stripping member 240 that is positioned in contact with the belt 220. The debris can cause circumferentially-extending raised bands to form on the outer surface 222 of the belt 220. These bands can be transferred from the belt 220 to media run in the fuser 200.

To reduce wear of the belt 220, it is desirable to strip media from the belt 220 using the stripping surface of the stripping member 240 with the smallest curvature (e.g., the stripping surface described by the largest radius for circular-shaped stripping surfaces) that produces a sufficiently-high stripping force to strip the media. For the stripping member 240, the second surface 274 (or, in other embodiments, the second surface 243) is shaped to produce a sufficiently-high stripping force to strip medium-weight and heavy-weight media from the belt 220. The smaller curvature of the second surface 274 (or the second surface 243) can significantly reduce wear of the belt 220 when the second surface 274 (or second surface 243) is used to strip such medium-weight and heavy-weight media, as compared to using the first surface 273 (or the first surface 242) described by a smaller radius for stripping such media.

For example, when the fuser 200 is normally used to run medium-weight or heavy-weight media, the wear rate of the belt 220 can be significantly reduced by using the second surface 274 (or second surface 243) for stripping these media. When the fuser 200 is used occasionally to run light-weight media, the first surface 273 (or first surface 242) of the stripping member 240 can be used to strip the light-weight media effectively. By limiting the amount of time that the first surface 273 (or first surface 242) contacts the belt 220, wear of the belt 220 can be significantly reduced as compared to using the first surface 273 (or first surface 242) for stripping light-weight media, medium-weight and heavy-weight media.

Other embodiments of the stripping member can include more than two stripping surfaces with different curvatures (e.g., surfaces described by different radii). Such stripping members can include an outer coating of a low-friction material, such as the coating 249, which contacts the belt. For example, such stripping members can include three corners with a stripping surface at each corner. In such embodiments, the first, second and third stripping surfaces can have, e.g., circular shapes described by a small first radius (e.g., about 0.5 mm or less), a medium second radius (e.g., about 1 mm to about 2 mm), and a large third radius (e.g., about 4 mm to about 5 mm), respectively. The optional coating increases the length of the radii describing the stripping surfaces by an amount dependent on the thickness of the coating. The first stripping surface can be used to strip light-weight media, the second stripping surface to strip medium-weight media, and the third stripping surface to strip heavy-weight media. In other embodiments, the stripping member can include, e.g., four corners having respective stripping surfaces with different curvatures (e.g., described by different radii) for additional selectivity.

As shown in FIGS. 4 to 6, the fuser 200 includes a cleaning member 244 adapted to clean the outer surface of the stripping member 240 that contacts the belt 220. In the illustrated embodiment, the coating 249 is cleaned by the cleaning member 244. In embodiments of the stripping member 240 that do not include the coating 249, the cleaning member 244 cleans the outer surface 248. The cleaning member 244 includes a cleaning pad 245 positioned to contact the outer surface of the coating 249 (or, in other embodiments, the outer surface 248). The cleaning pad 245 can be comprised of any suitable material(s) effective to remove solid and liquid debris from the coating 249 (or outer surface 248) of the stripping member 240. A spring 246 is connected to the cleaning pad 245 and a support 247 to resiliently bias the cleaning pad 245 against the outer surface of the coating 249.

The outer surface of the stripping member 240 is cleaned by rotating the stripping member 240 about the shaft 241 relative to the cleaning pad 245. In embodiments, the stripping member 240 can be rotated without interference with the fuser roll 202. Cleaning of the outer surface can be performed, e.g., when a different media type is to be run in the printing apparatus, or after a pre-determined number of prints have been made in the fuser 200. By cleaning the outer surface of the stripping member 240 using the cleaning member 244, the accumulation of debris between the stripping member 240 and the belt 220 can be reduced, resulting in reduced wear of the belt 220 and improved image quality.

Embodiments of the stripping members can also be used in apparatuses useful for printing to assist stripping of media from belts that have different structures and functions than fuser belts. For example, the stripping members can be used in printing apparatuses to assist stripping of media from photoreceptor belts used to transfer images to media, and in printing apparatuses to assist stripping of media from intermediate belts used to transport images that are transferred to media. Apparatuses useful for printing can include more than one stripping member for stripping media from more than one belt included in printing apparatuses.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first roll;

a belt including an inner surface and an outer surface, the first roll and the outer surface of the belt forming a nip;

a stripping member located internal to the belt, the stripping member including at least a first stripping surface and a second stripping surface having a smaller curvature than the first stripping surface, wherein the stripping member is selectively rotatable to at least a first position and a second position, wherein the first stripping surface contacts the inner surface of the belt in the first position, and the second stripping surface contacts the inner surface of the belt in the second position; and a cleaning member, the cleaning member being configured for cleaning the first stripping surface and the second stripping surface;

wherein the one of the first stripping surface and the second stripping surface facilitates stripping of media fed to the nip from the outer surface of the belt.

2. The apparatus of claim 1, wherein:

the first stripping surface is circular-shaped and described by a radius length of about 0.5 mm to about 2 mm; and the second stripping surface is circular-shaped and described by a radius length of about 4 mm to about 5 mm.

3. The apparatus of claim 1, the cleaning member further comprising a cleaning pad resiliently biased against an outer surface of the stripping member that includes the first stripping surface and the second stripping surface, wherein the outer surface of the stripping member is cleaned by rotating the stripping member relative to the cleaning member with the cleaning pad in contact with the outer surface of the stripping member.

4. The apparatus of claim 1, wherein the stripping member comprises a coating of a low-friction material, which includes the first stripping surface and the second stripping surface, to reduce frictional contact between the inner surface of the belt and the one of the first stripping surface and the second stripping surface.

5. A printing apparatus comprising the apparatus according to claim 1.

6. An apparatus useful for printing, comprising:

a first roll;

a second roll;

a belt disposed between the first roll and second roll, the belt including an inner surface and an outer surface;

a primary nip formed by the belt contacting the first roll and the second roll, the primary nip including an inlet end where a medium enters the primary nip and an outlet end where the medium exits the primary nip;

a stripping member located between the second roll and the inner surface of the belt, the stripping member including at least a first stripping surface and a second stripping surface having a smaller curvature than the first stripping surface, wherein the stripping member is selectively rotatable to at least a first position and a second position, wherein the first stripping surface contacts the inner surface of the belt in the first position, and the second stripping surface contacts the inner surface of the belt in the second position to strip the medium from the belt after the medium exits from the outlet end of the primary nip; and a cleaning member, the cleaning member being configured for cleaning the first stripping surface and the second stripping surface.

7. The apparatus of claim 6, wherein:

the belt separates from the second roll at the outlet end of the primary nip; and a secondary nip is formed by contact of the outer surface of the belt and the first roll between the outlet end of the primary nip and the one of the first stripping surface and the second stripping surface positioned in contact with the inner surface of the belt.

8. The apparatus of claim 6, wherein:

the first stripping surface is circular-shaped and described by a radius length of about 0.5 mm to about 2 mm; and the second stripping surface is circular-shaped and described by a radius length of about 4 mm to about 5 mm.

9. The apparatus of claim 6, wherein the cleaning member includes a cleaning pad resiliently biased against an outer surface of the stripping member including the first stripping surface and second stripping surface, and wherein the cleaning member cleans the outer surface of the stripping member by rotating the stripping member relative to the cleaning member with the cleaning pad in contact with the outer surface of the stripping member.

10. The apparatus of claim 6, wherein the stripping member comprises an outer coating of a low-friction material, which includes the first stripping surface and the second stripping surface, effective to reduce frictional contact between the inner surface of the belt and the stripping member.

11. The apparatus of claim 6, further comprising:

a third roll; and at least one heating element disposed inside of each of the second roll and the third roll;

wherein the second roll and the third roll support the belt.

12. A printing apparatus comprising the apparatus according to claim 6.

13. A method of stripping media from a surface in an apparatus useful for printing, the apparatus comprising a first roll, a belt including an inner surface and an outer surface, and a nip formed by the first roll and the outer surface of the belt, the method comprising:

contacting a first medium carrying a first marking material with the outer surface of the belt at the nip;

rotating a stripping member including at least a first stripping surface and a second stripping surface having a different curvature than the first stripping surface to selectively position the first stripping surface in contact with the inner surface of the belt, the stripping member being configured to cause the first stripping surface to contact the inner surface in a first stripping member position, and the second stripping surface to contact the inner surface in a second stripping member position;

stripping the first medium from the belt using the stripping member with the first stripping surface in contact with the inner surface; and cleaning the first stripping surface and the second stripping surface using a cleaning member.

14. The method of claim 13, wherein:

the first stripping surface is circular-shaped and described by a radius length of about 0.5 mm to about 2 mm; and the second stripping surface is circular-shaped and described by a radius length of about 4 mm to about 5 mm.

15. The method of claim 13, further comprising cleaning an outer surface of the stripping member including the first stripping surface and second stripping surface using a cleaning pad in contact with the outer surface of the stripping member.

16. The method of claim 13, wherein:

the inner surface of the belt contacts a second roll;

the nip includes a primary nip formed by contact between the second roll and the belt and contact between the belt and the first roll, the primary nip having an inlet end at which the first medium enters the primary nip and an outlet end at which the first medium exits from the primary nip;

the belt separates from the second roll at the outlet end of the primary nip;

the stripping member is located between the second roll and the belt; and a secondary nip is formed by the outer surface of the belt and an outer surface of the first roll adjacent the outlet end of the primary nip.

17. The method of claim 13, further comprising:

contacting a second medium carrying a second marking material with the outer surface of the belt at the nip, wherein the second medium has a higher weight than the first medium;

rotating the stripping member to position the second stripping surface in contact with the inner surface of the belt, wherein the second stripping surface has a smaller curvature than the first stripping surface; and stripping the second medium from the belt using the stripping member with the second stripping surface in contact with the inner surface.

18. The method of claim 13, wherein:

the first marking material is a first toner having a first fusing temperature;

the belt is a continuous belt;

the apparatus comprises a second roll and a third roll supporting the belt; and the second roll and the third roll each include at least one heating element which is actuated to heat the belt to at least the first fusing temperature to fuse the first toner on the first medium.

* * * * *